US010684098B2

(12) United States Patent
Tang

(10) Patent No.: US 10,684,098 B2
(45) Date of Patent: Jun. 16, 2020

(54) SIGHT AND ADJUSTING MECHANISM THEREOF

(71) Applicants: Sintai Optical (Shenzhen) Co., Ltd., ShenZhen, Guandong Province (CN); Asia Optical Co., Inc., Taichung (TW)

(72) Inventor: Chia-Chi Tang, Taichung (TW)

(73) Assignees: SINTAI OPTICAL (SHENZHEN) CO., LTD., Shenzhen, Guandong Province (CN); ASIA OPTICAL CO., INC., Taichung (TW)

( * ) Notice: Subject to any disclaimer, the term of this patent is extended or adjusted under 35 U.S.C. 154(b) by 9 days.

(21) Appl. No.: 16/170,095

(22) Filed: Oct. 25, 2018

(65) Prior Publication Data

US 2019/0128644 A1 May 2, 2019

(30) Foreign Application Priority Data

Nov. 2, 2017 (CN) ..... 2017 1 1063811

(51) Int. Cl.
*F41G 1/38* (2006.01)
*F41G 1/54* (2006.01)

(52) U.S. Cl.
CPC ..... *F41G 1/545* (2013.01); *F41G 1/38* (2013.01)

(58) Field of Classification Search
CPC ..... F41G 1/545; F41G 1/38; F41G 1/54
USPC ..... 42/119, 122
See application file for complete search history.

(56) References Cited

U.S. PATENT DOCUMENTS 6,643,970 B2 * 11/2003 Huber ..... F41G 1/38 42/119
8,166,696 B2 * 5/2012 Hamilton ..... F41G 1/38 359/429
8,270,104 B2 * 9/2012 Windauer ..... F41G 1/18 359/821
8,397,420 B2 * 3/2013 Hamilton ..... F41G 1/38 359/429
10,190,848 B2 * 1/2019 Vanbecelaere ..... F41G 1/38
2011/0261449 A1 * 10/2011 Schmitt ..... G02B 27/36 359/428
2017/0211912 A1 * 7/2017 Hamilton ..... F41G 1/38

* cited by examiner

*Primary Examiner* — Reginald S Tillman, Jr.
(74) *Attorney, Agent, or Firm* — McClure, Rodack & Qualey, LLP.

(57) ABSTRACT

A sight includes an adjusting mechanism including a fixing unit, a cover and an switching unit. The cover includes a groove. The switching unit is disposed on the fixing unit and includes a guiding member and a rotatable disc, wherein the guiding member includes a first end and a second end, the rotatable disc includes a surface, the surface has a first portion and a second portion, the first end faces the groove, and the second end faces the surface. The first end is outside the groove when the second end is placed against the second portion. The first end is inside the groove when the second end is placed against the first portion so that rotation of the cover is constrained.

19 Claims, 6 Drawing Sheets

SIGHT AND ADJUSTING MECHANISM THEREOF

BACKGROUND OF THE INVENTION

Field of the Invention

The invention relates to a sight and an adjusting mechanism thereof, and more particularly to a sight capable of being rapidly restored to a zero-point-set state and an adjusting mechanism thereof.

Description of the Related Art

Generally, before bullet impact points are corrected, setting a sight to a zero-point state is performed wherein an adjusting screw of an adjusting mechanism of the sight is adjusted to a reference position so that bullet impact points can be precisely corrected. However, the adjusting mechanism may have experienced operation many times when a correction of bullet impact points is performed. If correcting bullet impact points for a new target at a different distance is desired, it is difficult for a user to adjust the adjusting screw to the reference position. It is inconvenient for the user.

BRIEF SUMMARY OF THE INVENTION

The invention provides a sight and adjusting mechanism thereof, wherein the sight is capable of being rapidly restored to a zero-point-set state by a transformable switching unit.

An adjusting mechanism in accordance with an embodiment of the invention includes a fixing unit, a cover and a switching unit. The cover includes a groove. The switching unit is disposed on the fixing unit and includes a guiding member and a rotatable disc, wherein the guiding member includes a first end and a second end, the rotatable disc includes a surface, the surface has a first portion and a second portion, the first end faces the groove, and the second end faces the surface. The first end is outside the groove when the second end is placed against the second portion. The first end is inside the groove when the second end is placed against the first portion so that rotation of the cover is constrained.

In another embodiment, the surface is an unequal altitude surface, and the first portion is higher than the second portion.

In yet another embodiment, the unequal altitude surface is a sloping surface.

In another embodiment, the rotatable disc further includes a locating portion configured to fix the rotatable disc when the second end is placed against the second portion or the first portion.

In yet another embodiment, the fixing unit includes a first engaging portion and a second engaging portion, the locating portion is engaged with the first engaging portion when the second end is placed against the second portion, and the locating portion is engaged with the second engaging portion when the second end is placed against the first portion.

In another embodiment, the rotatable disc further includes an operating part configured to rotate the rotatable disc with respect to the guiding member for placing the second end against the first portion or the second portion.

In yet another embodiment, the fixing unit includes a slot, the operating part penetrates through the slot in a radial direction of the rotatable disc and is movable along the slot to rotate the rotatable disc.

In another embodiment, the switching unit further includes a limiting member, the guiding member is disposed in the limiting member, the first end does not protrude from the limiting member when the second end is placed against the second portion, and the first end protrudes from the limiting member when the second end is placed against the first portion.

In yet another embodiment, the cover further includes a stopping portion, and rotation of the cover is blocked when the first end enters the groove and is placed against the stopping portion.

In another embodiment, the adjusting mechanism further includes an adjusting unit disposed in the fixing unit, wherein the cover is connected to the adjusting unit and is configured to rotate and axially move the adjusting unit with respect to the fixing unit.

In yet another embodiment, the adjusting mechanism is an elevation adjusting mechanism or a windage adjusting mechanism.

In another embodiment, the first portion comprises a first engaging portion, and the second portion comprises a second engaging portion, the second end is engaged with the first engaging portion when the second end is placed against the first portion, and the second end is engaged with the second engaging portion when the second end is placed against the second portion.

A sight in accordance with an embodiment of the invention includes a main body, an erecting unit and the adjusting mechanism described above. The erecting unit is disposed within the main body. The fixing unit is disposed on the main body, and the adjusting unit extends from the fixing unit, penetrates into the main body and is placed against the erecting unit.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
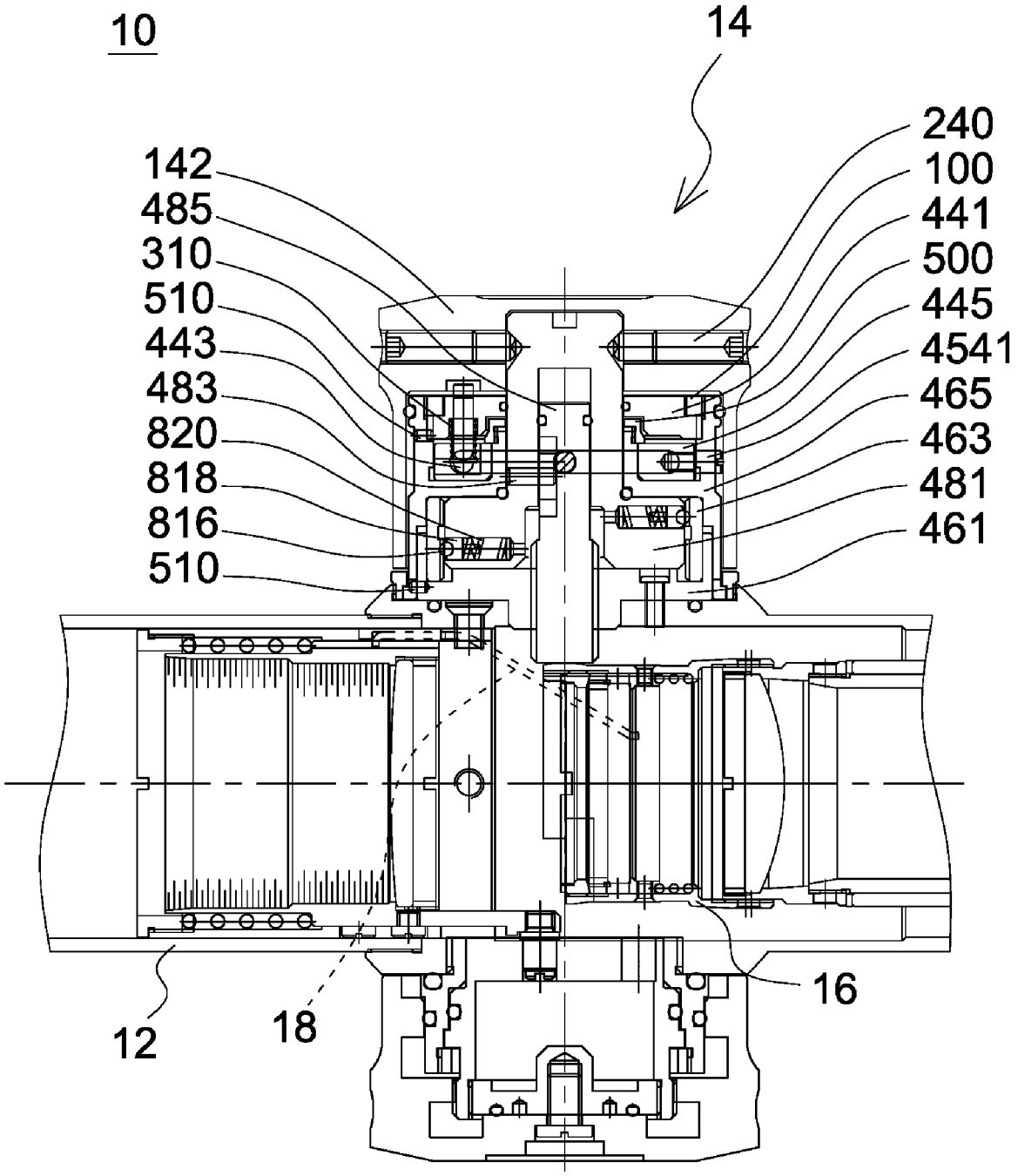
FIG. 1 is a sectional view of a sight in accordance with an embodiment of the invention.

Referring to FIG. 1, a sight 10 in accordance with an embodiment of the invention includes a main body 12, an adjusting mechanism 14, an erecting unit 16 and an elastic member (not shown), wherein the erecting unit 16 is disposed within the main body 12, the adjusting mechanism 14 is disposed on the main body 12, penetrates through the main body 12 and is placed against the erecting unit 16, and the elastic member is disposed on inner circumferential surfaces of the main body 12 and is placed against the erecting unit 16.

In present embodiment, the elastic member is a flat spring which can be deformed by the erecting unit 16 to produce a restoring force so as to continuously push the erecting unit 16 against the adjusting mechanism 14. It is worth noting that the elastic member is not shown in FIG. 1 because the elastic member is obscured from view by the erecting unit 16 (that is, it is unable to see the elastic member in the sectional view of the sight 10 of the FIG. 1). However, a person having ordinary skill in the art is not influenced to understand that the elastic member is actually disposed on the inner circumferential surfaces of the main body 12 and is placed against the erecting unit 16.

Figure 2A:
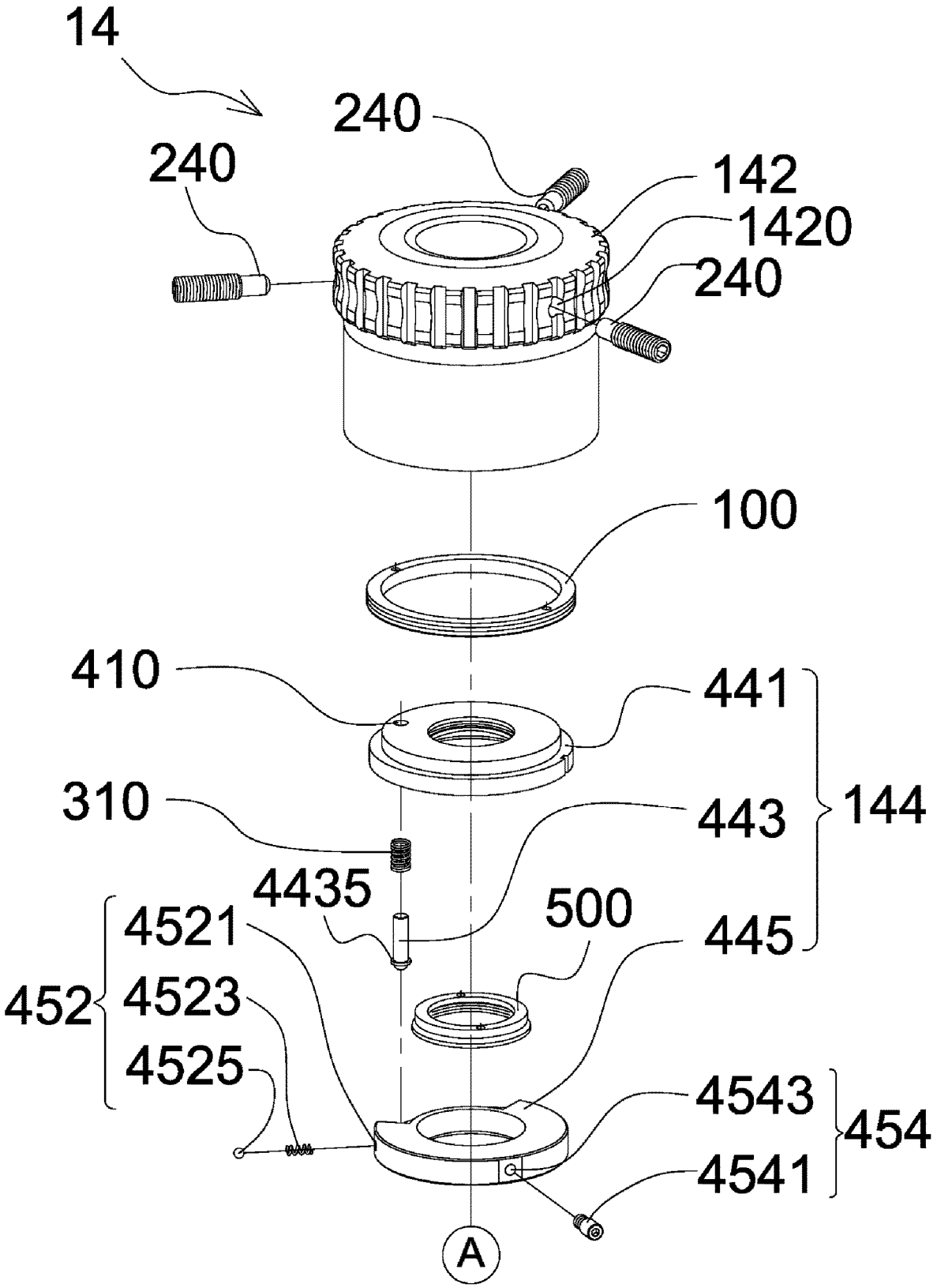
FIG. 2A is an exploded view of a part of an adjusting mechanism of the sight of FIG. 1.
Figure 2B:
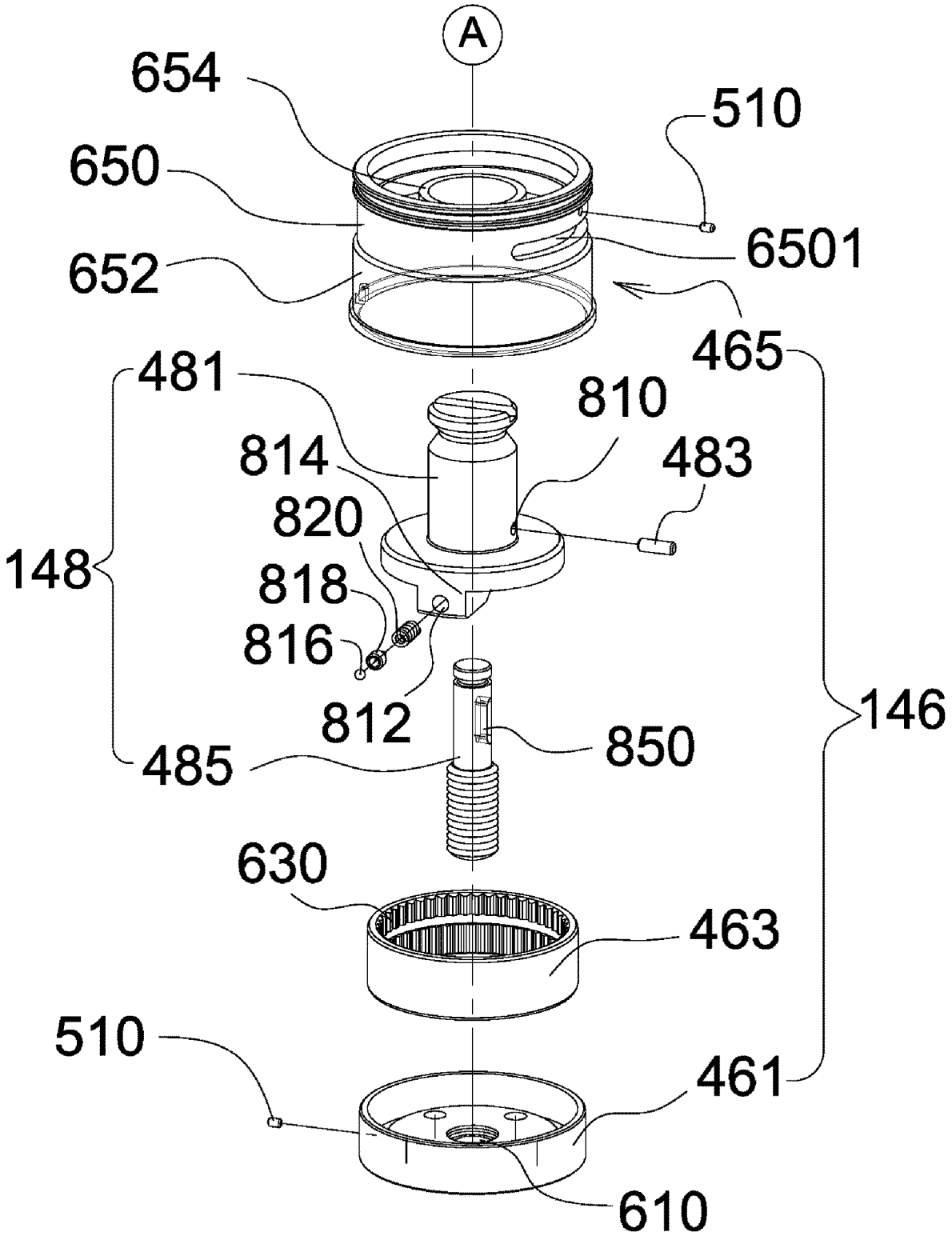
FIG. 2B is an exploded view of the other part of the adjusting mechanism of the sight of FIG. 1.

Referring to FIGS. 2A and 2B, the adjusting mechanism 14 includes a cover 142, an switching unit 144, a fixing unit 146 and an adjusting unit 148, wherein the fixing unit 146 is fixed on the main body 12, the switching unit 144 and the adjusting unit 148 are disposed in the fixing unit 146, and the cover 142 is configured to rotate the adjusting unit 148 for axially moving the adjusting unit 148 with respect to the fixing unit 146 so as to correct bullet impact points. The switching unit 144 is configured to change operation of the adjusting mechanism 14 and includes a limiting member 441, a guiding member 443 and a rotatable disc 445. The fixing unit 146 includes a barrier 465, a ring gear 463 and a base 461. The adjusting unit 148 includes a pivot shaft 481 and an adjusting member 485. In present embodiment, the adjusting mechanism 14 is an elevation adjusting mechanism or a windage adjusting mechanism.

The base 461 is fixed on the main body 12. The ring gear 463 is disposed in the base 461. The adjusting member 485 is disposed in the base 461 and penetrates through an adjusting hole 610 at a center of the base 461. A pin 483 is disposed in a through hole 810 of the pivot shaft 481 and penetrates into an indentation 850 of the adjusting member 485 so that the pivot shaft 481 and the adjusting member 485 are linked. An outer circumferential wall of the adjusting member 485 is provided with outer threads, and an inner circumferential wall of the adjusting hole 610 is provided with inner threads configured to engage with the outer threads. Thus, the pivot shaft 481 is able to rotate the adjusting member 485 through the pin 483 so that the adjusting member 485 is axially moved with respect to the base 461 for moving the erecting unit 16 in the main body 12. It is worth noting that a maximum distance at which the adjusting member 485 can be axially moved with respect to the base 461 is equal to a length of the indentation 850.

A plurality of axial indentations 630 are provided on an inner circumferential wall of the ring gear 463 and spaced equally. The pivot shaft 481 has two protruding portions 814 in which two blind holes 812 are respectively provided. Each of the blind holes 812 has an elastic element 820, a ball seat 818 and a ball member 816 sequentially disposed therein. The ball member 816 is disposed on the ball seat 818, and the ball seat 818 is forced by a restoring force generated by the elastic element 820 to push the ball member 816 against the indentations 630. Therefore, the ball member 816 is able to move between the indentations 630 to make clicking sound (or vibration) for a user when the pivot shaft 481 is rotated.

Figure 3A:
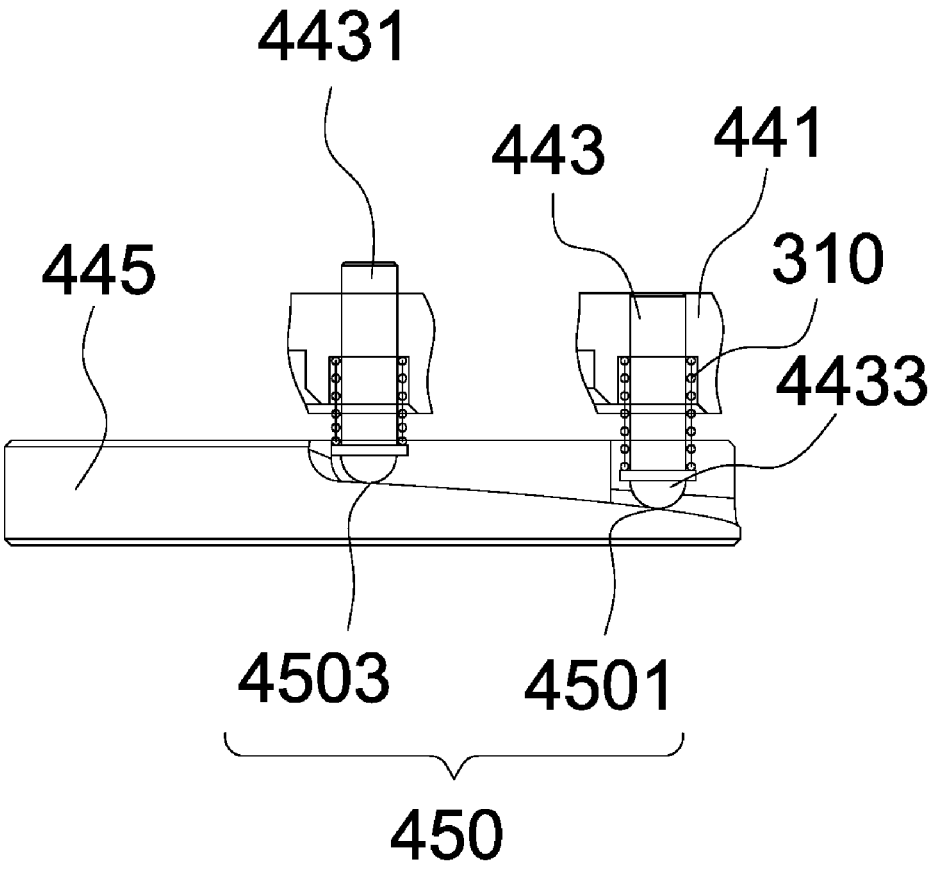
FIG. 3A is a schematic view of an switching unit of FIG. 2A.
Figure 3B:
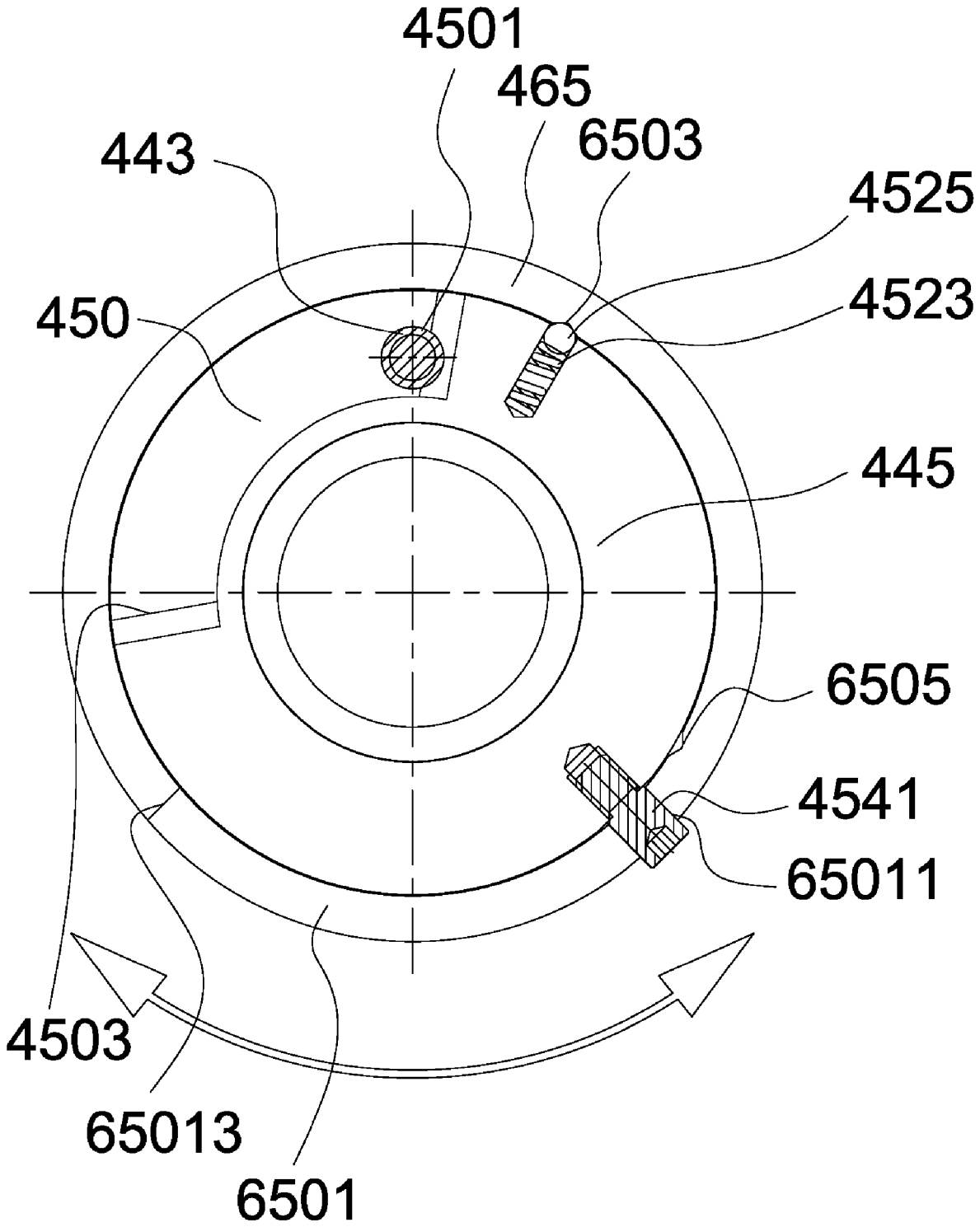
FIG. 3B is a top view of a guiding member of FIG. 3A, placed against a sloping surface of a rotatable disc.

The barrier 465 is externally fixed to the base 461 through a pin 510. The barrier 465 includes an upper barrel 650, a lower barrel 652 and an axial hole 654. The base 461, the ring gear 463, the pivot shaft 481 and the adjusting member 485 are accommodated in the lower barrel 652. The pivot shaft 481 penetrates through the axial hole 645. The switching unit 144 is disposed in the upper barrel 650. During assembly of the switching unit 144, the rotatable disc 445 is disposed in the upper barrel 650 and held by a first junk ring 500, and a first end 4431 (as shown in FIGS. 3A and 3B) of the guiding member 443 is sequentially penetrated through an elastic element 310 and a limiting hole 410 of the limiting member 441 for compressing the elastic element 310 between a flange 4435 of the guiding member 443 and an interior of the limiting member 441. After assembling the limiting member 441 and the guiding member 443, the limiting member 441 is fixed in the upper barrel 650 by means of a second junk ring 100 and another pin 510.

Referring to FIGS. 3A and 3B, the rotatable disc 445 includes a sloping surface 450, a locating portion 452 and an operating part 454. A second end 4433 of the guiding member 443 is placed against the sloping surface 450 when the switching unit 144 is disposed in the upper barrel 650. The sloping surface 450 includes a high point 4503 and a low point 4501. When the second end 4433 of the guiding member 443 is placed against the high point 4503, the elastic element 310 is compressed more by the flange 4435 so that the first end 4431 protrudes from the limiting member 441. When the second end 4433 of the guiding member 443 is placed against the low point 4501, the elastic element 310 is partially released and pushes the flange 4435 downward so that the first end 4431 does not protrude from the limiting member 441. The operating part 454 is configured to rotate the rotatable disc 445 with respect to the barrier 465 and the guiding member 443 so that the second end 4433 can switch between the high point 4503 and the low point 4501 of the sloping surface 450, thereby determining whether the first end 4431 of the guiding member 443 protrudes from the limiting member 441 or not. The locating portion 452 is configured to fix the rotatable disc 445 as the second end 4433 is switched to the high point 4503 or the low point 4501 by the operating part 454. The operating part 454 includes a force receiving member 4541 and a fixing hole 4543, wherein the force receiving member 4541 is fixed in the fixing hole 4543 and penetrates through a slot 6501 of the upper barrel 650 in a radial direction of the rotatable disc 445 (that is, the operating part 454 protrudes outward from the barrier 465). The locating portion 452 includes a blind hole 4521, an elastic element 4523 and a ball member 4525, wherein the elastic element 4523 and the ball member 4525 are sequentially disposed in the blind hole 4521. The ball member 4525 is forced by a restoring force generated by the elastic element 4523 to engage with a first engaging portion 6503 or a second engaging portion 6505 of an inner circumferential wall of the upper barrel 650. The guiding member 443 may be rod-shaped, ball-shaped or polygonal, or be any element which is provided with two ends.

In brief, the force receiving member 4541 can be moved between two ends of the slot 6501 for changing the structural arrangement of the switching unit 144. As shown in FIGS. 3A and 3B, when the force receiving member 4541 is moved to a first end 65011 of the slot 6501, the guiding member 443 is placed against the low point 4501 of the sloping surface 450 and the ball member 4525 is engaged with the first engaging portion 6503 so that the guiding member 443 stays without protruding from the limiting member 441. If the force receiving member 4541 in FIG. 3B is moved clockwise to a second end 65013 of the slot 6501, the guiding member 443 is placed against the high point 4503 of the sloping surface 450 and the ball member 4525 is engaged with the second engaging portion 6505 so that the guiding member 443 stays to protrude from the limiting member 441.

Figure 4:
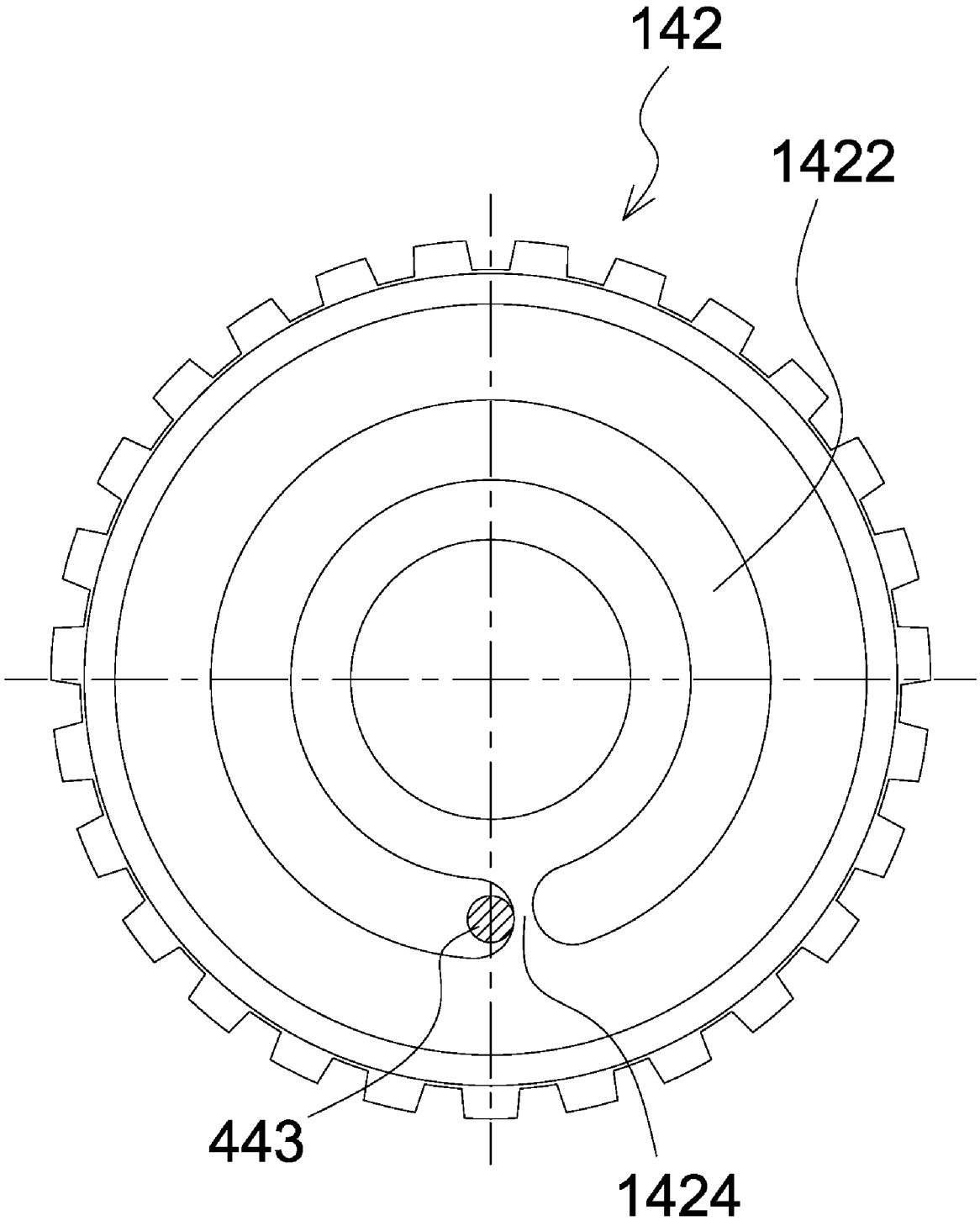
FIG. 4 is a schematic view of the guiding member of FIG. 2A, penetrating into a groove of a cover.

As described, the pivot shaft 481 penetrates through the axial hole 654. Referring to FIGS. 1, 2A and 2B, the pivot shaft 481 further penetrates through the switching unit 144. Three fixing screws 240 respectively penetrate through three fixing holes 1420 of the cover 142 for connecting the cover 142 to the pivot shaft 481. In such arrangement, the adjusting member 485 is axially moved with respect to the base 461 when the cover 142 is rotated. As shown in FIG. 4, an interior of the cover 142 is provided with a groove 1422 and a stopping portion 1424. When the guiding member 443 protrudes from the limiting member 441, the first end 4431 of the guiding member 443 enters the groove 1422 so that rotation of the cover 142 is constrained by the stopping portion 1424. When the guiding member 443 does not protrude from the limiting member 441, the first end 4431 of the guiding member 443 does not enter the groove 1422 so that rotation of the cover 142 is not constrained by the stopping portion 1424. In present embodiment, the groove 1422 and the stopping portion 1424 constitute a circle.

Before bullet impact points are corrected, setting a zero point for the sight 10 is required. During the setting operation, the adjusting unit 148 is placed in position for setting the zero-point-set state, with the guiding member 443 protruding from the limiting member 441. The stopping portion 1424 of the cover 142 is placed against the first end 4431 of the guiding member 443 (as shown in FIG. 4). The cover 142 is adjusted to be in a zero-point position (that is, a beginning position for correcting bullet impact points). After the cover 142 is adjusted to be in the zero-point position, the operating part 454 is moved until the second end 4433 of the guiding member 443 is placed against the low point 4501 of the sloping surface 450, and the first end 4431 of the guiding member 443 is drawn into the limiting member 441. Afterward, the correction of bullet impact points can be performed.

Adjusting the sight 10 back to the zero-point-set state is described as follows. The operating part 454 is manually moved to place the second end 4433 of the guiding member 443 against the high point 4503 of the sloping surface 450 so that the first end 4431 of the guiding member 443 protrudes from the limiting member 441 and enters the groove 1422. After the first end 4431 of the guiding member 443 enters the groove 1422, the cover 142 is rotated in a reverse direction until the stopping portion 1424 contacts the first end 4431 of the guiding member 443. Then, the cover 142 is blocked from further rotating, and the cover 142 is adjusted to be in the zero-point position (that is, the sight 10 is adjusted back to the zero-point-set state).

In another embodiment, the locating portion 452, the first engaging portion 6503 and the second engaging portion 6505 are omitted, the high point 4503 of the sloping surface 450 is provided with a third engaging portion (not shown), and the low point 4501 of the sloping surface 450 is provided with a fourth engaging portion (not shown). When the force receiving member 4541 is moved to a first end 65011 of the slot 6501, the guiding member 443 is placed against the low point 4501 of the sloping surface 450 and is engaged with the fourth engaging portion so that the guiding member 443 stays without protruding from the limiting member 441. If the force receiving member 4541 is moved to a second end 65013 of the slot 6501, the guiding member 443 is placed against the high point 4503 of the sloping surface 450 and is engaged with the third engaging portion so that the guiding member 443 stays to protrude from the limiting member 441. The arrangement of other elements and operation are similar to those of the above embodiment, and therefore the descriptions thereof are omitted.

In sum, since the sight 10 of the invention is provided with the switching unit 144, the sight 10 is capable of correcting bullet impact points and being rapidly restored to the zero-point-set state. The sight 10 can be operated to correct bullet impact points when the guiding member 443 does not protrude from the limiting member 441. On the other hand, when the guiding member 443 protrudes from the limiting member 441, the sight 10 can be restored to the zero-point-set state by adjusting the adjusting mechanism 14 in the reverse direction until the rotation is blocked. The user does not need to spend additional time to reset the zero point for the sight 10.

What is claimed is:

1. An adjusting mechanism configured to attach to a sight, comprising: a fixing unit; a cover comprising a groove; and a switching unit disposed on the fixing unit and comprising a guiding member and a rotatable disc, wherein the guiding member comprises a first end and a second end, the rotatable disc comprises a surface, the surface has a first portion and a second portion, the first end faces the groove, and the second end faces the surface; wherein the first end is outside the groove when the second end is placed against the second portion; wherein the first end is inside the groove when the second end is placed against the first portion so that rotation of the cover is constrained.

2. The adjusting mechanism as claimed in claim 1, wherein the surface is an unequal altitude surface, and the first portion is higher than the second portion.

3. The adjusting mechanism as claimed in claim 2, wherein the unequal altitude surface is a sloping surface.

4. The adjusting mechanism as claimed in claim 1, the rotatable disc further comprises a locating portion configured to fix the rotatable disc when the second end is placed against the second portion or the first portion.

5. The adjusting mechanism as claimed in claim 4, wherein the fixing unit comprises a first engaging portion and a second engaging portion, the locating portion is engaged with the first engaging portion when the second end is placed against the second portion, and the locating portion is engaged with the second engaging portion when the second end is placed against the first portion.

6. The adjusting mechanism as claimed in claim 1, wherein the rotatable disc further comprises an operating part configured to rotate the rotatable disc with respect to the guiding member for placing the second end against the first portion or the second portion.

7. The adjusting mechanism as claimed in claim 6, wherein the fixing unit comprises a slot, the operating part penetrates through the slot in a radial direction of the rotatable disc and is movable along the slot to rotate the rotatable disc.

8. The adjusting mechanism as claimed in claim 1, wherein the switching unit further comprises a limiting member, the guiding member is disposed in the limiting member, the first end does not protrude from the limiting member when the second end is placed against the second portion, and the first end protrudes from the limiting member when the second end is placed against the first portion.

9. The adjusting mechanism as claimed in claim 1, wherein the cover further comprise a stopping portion, and the rotation of the cover is blocked when the first end enters the groove and is placed against the stopping portion.

10. The adjusting mechanism as claimed in claim 1, further comprising an adjusting unit disposed in the fixing unit, wherein the cover is connected to the adjusting unit and is configured to rotate and axially move the adjusting unit with respect to the fixing unit.

11. The adjusting mechanism as claimed in claim 1, wherein the adjusting mechanism is an elevation adjusting mechanism or a windage adjusting mechanism.

12. The adjusting mechanism as claimed in claim 1, wherein the first portion comprises a first engaging portion, and the second portion comprises a second engaging portion, the second end is engaged with the first engaging portion when the second end is placed against the first portion, and the second end is engaged with the second engaging portion when the second end is placed against the second portion.

13. The adjusting mechanism as claimed in claim 12, wherein the switching unit further comprises a limiting member, the guiding member is disposed in the limiting member, the first end does not protrude from the limiting member when the second end is placed against the second portion, and the first end protrudes from the limiting member when the second end is placed against the first portion.

14. The adjusting mechanism as claimed in claim 12, wherein the cover further comprise a stopping portion, and the rotation of the cover is blocked when the first end enters the groove and is placed against the stopping portion.

15. The adjusting mechanism as claimed in claim 12, further comprising an adjusting unit disposed in the fixing unit, wherein the cover is connected to the adjusting unit and is configured to rotate and axially move the adjusting unit with respect to the fixing unit.

16. The adjusting mechanism as claimed in claim 1, wherein the first portion is higher than the second portion.

17. The adjusting mechanism as claimed in claim 16, wherein the first portion comprises a first engaging portion, and the second portion comprises a second engaging portion, the second end is engaged with the first engaging portion when the second end is placed against the first portion, and the second end is engaged with the second engaging portion when the second end is placed against the second portion.

18. The adjusting mechanism as claimed in claim 17, wherein the switching unit further comprises a limiting member, the guiding member is disposed in the limiting member, the first end does not protrude from the limiting member when the second end is placed against the second portion, and the first end protrudes from the limiting member when the second end is placed against the first portion.

19. A sight, comprising:

a main body;

an erecting unit disposed within the main body; and an adjusting mechanism as claimed in claim 10, wherein the fixing unit is disposed on the main body, and the adjusting unit extends from the fixing unit, penetrates into the main body and is placed against the erecting unit.

* * * * *